US005466353A

United States Patent [19]

Westermann et al.

[11] Patent Number: 5,466,353

[45] Date of Patent: Nov. 14, 1995

[54] ELECTRIC POWER DISTRIBUTION SYSTEM FOR ACTIVE CATHODIC PROTECTION OF REINFORCED CONCRETE CONSTRUCTIONS

[75] Inventors: Soeren E. Westermann, Hellerup; Erik Schultz, Ballerup, both of Denmark

[73] Assignee: Cyberdan A/S, Holte, Denmark

[21] Appl. No.: 244,056

[22] PCT Filed: Nov. 16, 1992

[86] PCT No.: PCT/EP92/02629

§ 371 Date: May 13, 1994

§ 102(e) Date: May 13, 1994

[87] PCT Pub. No.: WO93/11279

PCT Pub. Date: Jun. 10, 1993

[30] Foreign Application Priority Data

Nov. 28, 1991 [DK] Denmark ..... 1929/91

[51] Int. Cl.[6] ..... C23F 13/00

[52] U.S. Cl. ..... 204/196; 204/147

[58] Field of Search ..... 204/147, 148, 204/196, 197

[56] References Cited

U.S. PATENT DOCUMENTS

| | | | |
|---|---|---|---|
| 3,556,971 | 1/1971 | Husock | 204/196 |
| 3,841,988 | 10/1974 | Gleason | 204/147 |
| 4,255,241 | 3/1981 | Kroon et al. | 204/147 |
| 4,795,539 | 1/1989 | Bianchi | 204/196 |

FOREIGN PATENT DOCUMENTS

| | | |
|---|---|---|
| 1246676 | 12/1988 | Canada . |
| 2140456 | 11/1984 | United Kingdom . |

OTHER PUBLICATIONS

*Werkstoffe und Korrosion,* vol. 31, No. 10, 1980, Weinheim, p. 806, ab. no. 80–2775, J. L. Piazza, "Computerized Continuous Potential Surveys Offshore".

*Primary Examiner*—T. Tung

*Attorney, Agent, or Firm*—Sughrue, Mion, Zinn, Macpeak & Seas

[57] ABSTRACT

An electric power distribution system permitting active cathodic protection of reenforced concrete structures includes a converter device converting a mains supply voltage to low voltage electrical power, a computer in close proximity to the converter device, a cabling system leading electric power from the converter to parts of the reinforced concrete structures requiring active cathodic protection, a device for providing electrical contact between the cabling system and reinforcing iron of the reinforced concrete structures, contact elements providing electrical contact with the concrete mass, and distributing devices for distributing electric power to respective contact elements. While there is only one cabling system, the system permits control of power applied to each respective distributing device and two way communication of digitally coded and addressed information between the computer and digital control portions associated with each of the distributing devices via the cabling system.

20 Claims, 3 Drawing Sheets

17
F
3
E
C
I
D
A
B

ELECTRIC POWER DISTRIBUTION SYSTEM FOR ACTIVE CATHODIC PROTECTION OF REINFORCED CONCRETE CONSTRUCTIONS

BACKGROUND OF THE INVENTION

1. Field of the Invention

Concrete renovation has grown into a very large field, ever increasing faster and faster, due to the enormous number of reinforced concrete structures built after the second world war. The concrete renovations are necessary as it is extremely difficult to produce concrete structures of such high quality that reinforcement corrosion is avoided. When the reinforcement corrodes, the concrete structure gradually looses its strength. Reinforcement corrosion typically occurs as a result of the destruction of the highly alkaline environment of concrete, e.g., due to cracks in the concrete cover. The cracks are often so fine that they can not be spotted with the naked eye—but are large enough to allow moisture to penetrate and start the corrosion process. Around the cracks, areas emerge emitting iron ions as part of an electric circuit. See FIG. 2. Such an area is the anode of the circuit. Electrons which are freed at the anode are consumed elsewhere along the reinforcement—the cathode of the circuit—thus freeing hydroxide ions (OH—ions). Iron ions and OH—ions together create rust.

2. Brief Discussion of Related Art

For a long time, concrete renovation has consisted of an optical inspection of the surface of the concrete by skilled people, taking out numerous samples of the structure using tubular drills, investigating the samples in laboratories, deciding which areas of the structure must be renewed, breaking up these areas, sand blasting the reinforcement, priming, pre-watering and filling the holes with repair mortar, possibly supplemented with surface treatment of the concrete. The durability of this kind of repair is not well known.

An alternative treatment is cathodic protection. Cathodic protection can only be used if the corrosion is not yet so advanced that the strength of the structure is critical.

Cathodic protection is particularly superior where breaking up the concrete is very inconvenient, i.e., at bridge piers and other structures carrying heavy weight.

Using this method, negative voltage is applied to the reinforcement, binding the positive iron ions to the steel. Typically the reinforcement is held at approximately –0.75 volt compared with the potential of the surrounding concrete. The positive pole of the circuit is typically established using drilled-in anodes or wire netting attached to the surface of the concrete.

In its simplest version, the cathodic protection system consists of a central power supply producing low voltage direct current, a wire connecting the negative supply outlet to the reinforcement, a cable (normally strongly ramified) that leads the positive voltage to the concrete areas to be protected, simple current distributors, and a number of drilled-in anodes. See FIG. 3. Normally, the distributor normally only consists of a series resistor for each anode and maybe one or two jumper selectable common series resistors to lower the common supply voltage and current.

In practice this type of installation has shown too primitive for most structures. The system does not normally allow for individual adjustment of the current to each anode and, more important, there is no immediate way that it can be controlled if the anodes functions as intended.

Presently, the most advanced systems have an over—and undervoltage detector for each anode built into the distributor. All the outputs of the undervoltage detectors are logically ORed and the output of the OR gate is then lead through a separate wire to a control panel near the power supply. The same holds for the overvoltage detectors so that for each distributor two separate wires lead to the control panel where each of them activates a warning light. The system does not tell which anode(s) are malfunctioning only that the malfunctioning anode(s) is(are) connected to a specific distributor.

Furthermore, for large concrete structures an overwhelming number of wires must be taken from the many distributors to the control panel.

Finally the system does not allow for individual adjustments of voltage/current to each anode.

SUMMARY OF THE INVENTION.

The present invention eliminates all the known drawbacks of existing cathodic protection systems and further offers extended security and flexibility. Finally, the invention forms a basis for gathering new knowledge and experience on controlling cathodic protection.

A cathodic protection system according to the invention is made up from five elements:

1) Power supply A, centrally positioned, delivers power to both the anodes E and the controlling sections of the distributing means F.
2) A computer B, typically an industrial Personal Computer (PC), with a computer program that overlooks and control the entire installation.
3) A bus type cabling system C that primarily distributes the electric power to the distributing means F and with these the anodes E and, secondly, it carries digitally coded information from the computer B to the distributing means F and from the distributing means F to the computer B.
4) Distributing means F, that control and distribute the voltage and or current to one or more anodes. Each distributing means would have a built in microcontroller 3 that can receive and transmit messages via the cabling system C. Further-more, the distributing means F has means for sensing and controlling the voltage and current to each anode or group of anodes.
5) Anodes E, either drilled into the concrete or covering the surface of the concrete as a wire netting.

The power supply A would ideally be connected to the reinforcement in a single point D but if the reinforcement is not completely interconnected and consists of isolated reinforcement sections, each section must be connected to the power supply, typically to the ground or negative outlet of the supply.

The computer B and power supply A would typically be built into the same enclosure also allowing the computer to directly supervise and control the function of the power supply.

The cabling system C would ideally be a two-wire-only system, transmitting both power and the digitally coded information on these two wires.

Two possibilities are available for the type of power supply:

ALTERNATING CURRENT, A/C, in which case the power supply A is merely a transformer possibly with some type of protection and each distributing means must therefore contain both a rectifier and a stabilizing means. This principle allows for a small transformer built into each distributor thereby galvanically isolating the distributor from the cabling system. This would typically require that each distributor be connected individually to the reinforcement.

DIRECT CURRENT, D/C, in which case the power supply A includes a rectifier, possibly some capacitive or inductive stabilizing means and possibly some protective circuitry. The negative power outlet is connected directly to the reinforcement sections and the positive and negative outlets are both connected to each distributing means by means of the very simple two wire system that may ramify or branch into a typical tree structure.

The distributing means F may have a further stabilizing element and directly supplies the anodes E.

Ideally, each distributing means F has an A/D-converter 16 and a multiplexer 15 so that the microcontroller 3 can measure voltage and current to each anode. Furthermore, the microcontroller would have controlling means 14—such as multiplying D/A-converters—for controlling voltage and/or current to each anode.

Finally each distributing means F would be given a unique preset address so that the computer B at any time could address the distributing means and collect information from or give commands to its microcontroller. In this way an operator could—from the central computer location—supervise and control the behavior of every single anode in the system.

A special address could be reserved for messages recognized by all distributors such as reset and self test operations.

As the corrosion processes act very slowly—it typically takes several years for a concrete structure to reach a critical stage—the digital communication can take place at a very slow transfer rate. For instance, sampling the status of each anode once every six hours will normally be sufficient and will allow even very large installations to be controlled from a rather modest computer, in particular, if each distributor's microcontroller is capable of recording irregularities that occurred since it was last addressed/polled by the computer.

The present invention has a number of advantages when compared to existing cathodic protection systems.

Firstly, the invention allows for a maximally simple cabling system—only two conductors (possibly branching into a tree structure) need to be installed. This, in turn, allows for a very rational installation procedure where electricians mass-install the cabling, the distributors and the many anodes.

Secondly, fully exploiting the invention, the function of each and every anode can be supervised and controlled centrally from the computer. This is of course of particular value if the anodes are mounted at positions difficult to access, such as underneath balconies, on bay bridge piers, etc.

Thirdly, the computer can log status and changes for each anode over any time period enabling very competent corrections to the control of each anode and facilitating an extension of the professional experience and knowledge in the field.

Fourthly, in case of severe errors the computer could easily be arranged to send some kind of alarm, e.g., via the telephone network.

Fifthly, if more experience is gained about how voltage and current to each anode is optimized when temperature, wind, direct sunshine, etc., changes, by attaching sensors for these parameters to the computer, the computer will be able to optimize voltage and current to each anode constantly.

Finally, if the invention is built into new concrete structures (typically with sparse concentration of anodes and with the supervisory functions active only—in particular if built into critical structures like underwater tunnels and bridge piers—an early warning can be obtained indicating that the structure is beginning to severely deteriorate and that full cathodic protection should be implemented.

BRIEF DESCRIPTION OF THE DRAWING FIGURES

DETAILED DESCRIPTION OF PREFERRED EMBODIMENTS

Figure 1:
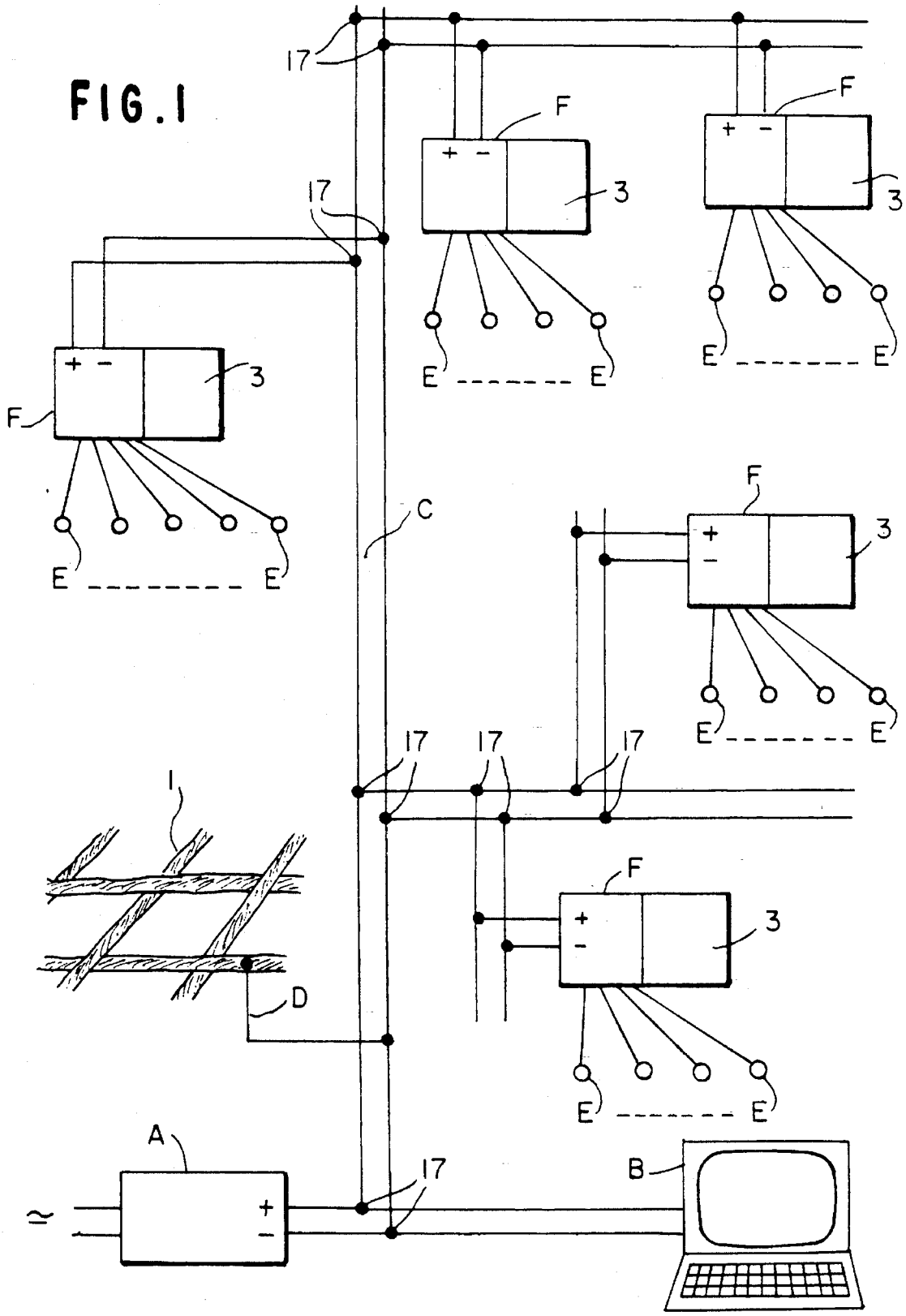
FIG. 1 illustrates an active cathodic protection system according to the invention.

In FIG. 1, main power enters into the main power supply A and is converted into low voltage. Normally, the power is rectified and smoothed, for instance, by means of large capacitors and/or inductors. The result could typically be a DC output of 10 to 30 volts.

Somewhere in the concrete structure, one or more holes are drilled leading to the reinforcement and a reliable connection D is established from the ground output (or most negative output) of the main power supply A to the reinforcement 1.

The cabling system C consists of a minimum of conductors and conducts power from the main power supply A to each of many distributing and controlling means F from which the power is distributed to the anodes E or to anode wire nettings. Ideally the cabling system consists of only two conductors that may branch or ramify in a possibly large number of branching points 17.

Preferably a computer B, which is located near the mains supply A, is connected to the cabling system C. The computer B has means for sending and/or receiving digitally coded information via the cabling system C.

A number of distributing and controlling means F are connected locally to the cabling system C near all those sections of the concrete that needs cathodic protection. Each distributing and controlling means supplies one or more drilled in anodes E or one or more wire nettings with electric power. Each anode or wire netting has its own output from a distributing and controlling means F, possibly with an individually set voltage or current value.

Each distributing and controlling means F has its own digital controller 3, which will normally be a microcontroller or a micro processor.

In a typical system according to the invention, the computer B will periodically send and receive digitally coded messages to/from each distributing and controlling means F. This can be made possible by giving each distributing and controlling means a unique address and having the computer perform a polling procedure where each distributing and controlling means receives a message with its own address from the computer and—if necessary—can transmit a reply message to the computer. The computer will typically have a controlling status so that all communication activities on the cabling system always are initiated by the computer.

Figure 2:
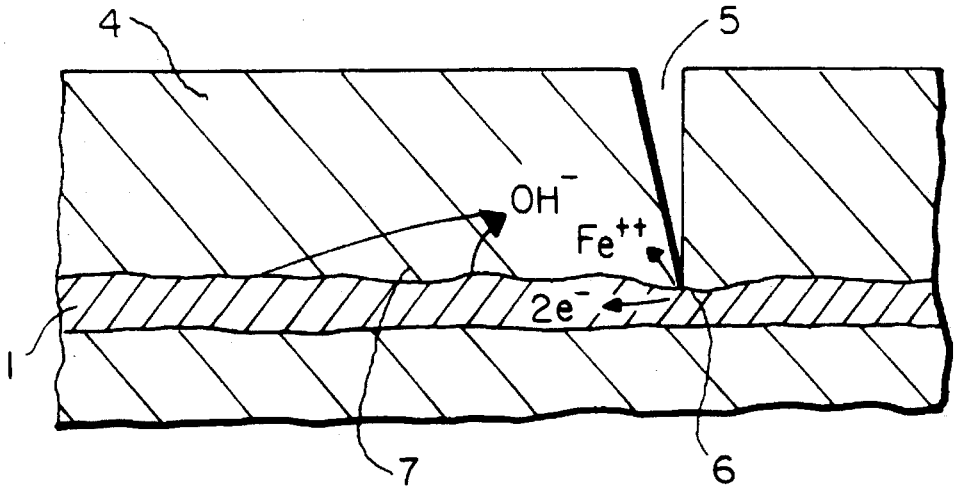
FIG. 2 illustrates the reinforcement corrosion process.

FIG. 2 illustrates the reinforcement corrosion process which the present invention is intended to stop. A section of concrete 4 can be seen with a reinforcement iron 1. A crack 5 allow moisture to penetrate and start the corrosion process at the anode areas 6. The anode process is:

$$Fe \rightarrow Fe^{+++} + 2e^-$$

and the freed electrons are consumed at cathode areas 7 along the reinforcement.

The cathode process is:

$$O_2 + 2\,H_2O + 4e \longrightarrow 4OH^-$$

Finally the iron ions and hydroxide ions together create rust.

Figure 3:
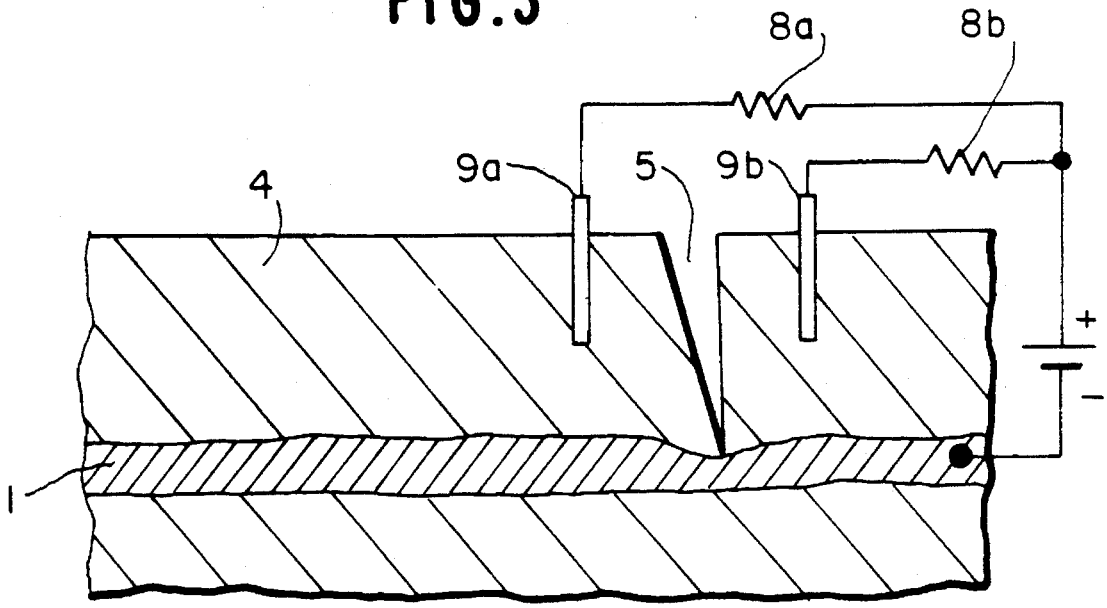
FIG. 3 is a principal diagram of an active cathodic protection system.

In FIG. 3, a principal diagram of active cathodic protection is shown.

By forcing the reinforcement 1 to a negative potential compared with the (humid) concrete 4, the positive iron ions are bound to the reinforcing steel 1 and thereby causes the corrosion process to stop. In the figure, drilled-in anodes 9*a* and 9*b* are placed near the corrosion area and supplied via series resistors 8*a* and 8*b* from a power supply.

Figure 4:
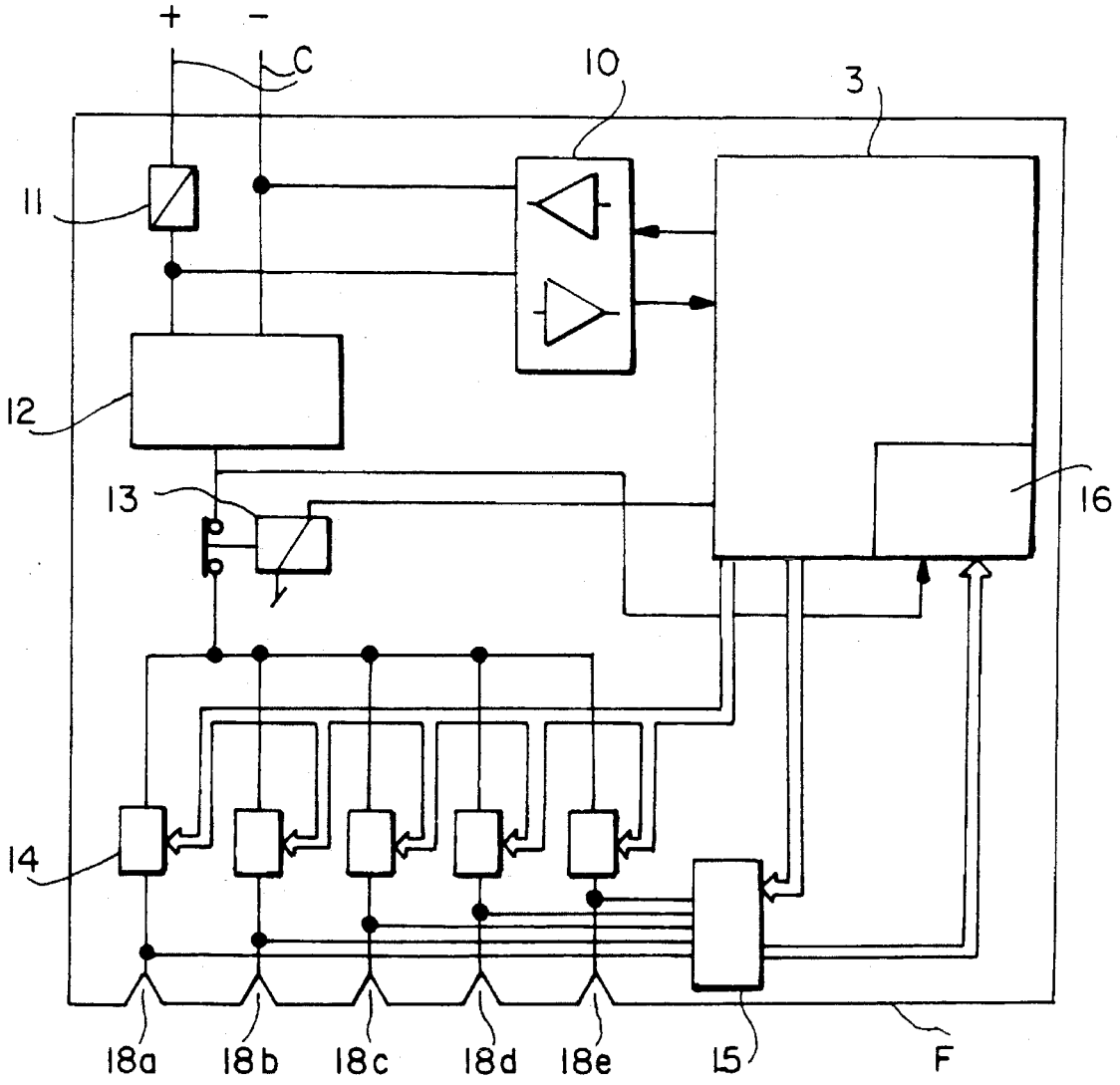
FIG. 4 shows the functional diagram of a preferred embodiment of the distributing and controlling means F according to the invention.

In FIG. 4, a distributing means F according to the invention is illustrated.

The distributing means F is connected to the cabling system C and would possibly have a fuse 11. The power is stabilized and regulated in the voltage regulator 12 that could be adjustable.

A receiver/transmitting means 10 unloads frequency modulated signals from the cabling system C and converts these signals into a binary representation compatible with the microcontroller/processor 3. The microcontroller/processor 3 correspondingly can send binary information to the receiver/transmitting means 10 which in turn will convert the information into frequency modulated signals and pass these to the cabling system C. The computer B in FIG. 1 would need a similar arrangement to enable communication between the computer and the distributing means.

From the voltage regulator 12 the power is taken through a relay 13 so that the microcontroller/processor 3 can interrupt the supply of the anodes thereby enabling a (possibly external) decay measurement of the potentials in the concrete.

From the relay 13 the power is split into several output lines each going through a voltage and/or current controlling means 14—typically a multiplying D/A converter—and finally leading to output terminals 18*a* to 18*e*. More or less output lines could be implemented depending on the particular needs.

The voltage/current controlling means 14 are controlled from the microcontroller/processor 3 which enables an individual adjustment of voltage and/or current to each anode.

The microcontroller/processor 3 has an external or built in analog-to-digital (A/D) converter 16 that can measure the voltage at the output of the voltage regulator 12 and by means of a multiplexer 15 and also the voltage at each of the output terminals 18*a* to 18*e*. Knowing the characteristics of the voltage/current controller 14, the microcontroller/processor 3 can measure the voltage and calculate the current to each anode.

On demand from the computer B, these values can now be transmitted to the computer.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

We claim:

1. An electric power distribution system for active cathodic protection of reinforced concrete structures, comprising:

converting means (A) for converting a main supply into low voltage electric power;

computational means (B) operatively coupled to the converting means (A);

a cabling system (C) leading said electric power from the converting means (A) to respective portions of the reinforced concrete structures that need active cathodic protection;

providing means (D) for providing electrical contact from the converting means (A) to reinforcing iron (1);

contact means (E) for providing electrical contact with a respective concrete mass; and means (F) for locally distributing said electric power to said contact means (E), said distributing means (F) further comprising a built-in digital control section including a unique address;

wherein only one cabling system (C) is provided, wherein said computational means (B) is capable of sending and receiving digitally coded and addressed information via said cabling system (C), and wherein said digital control section is also capable of sending and receiving said digitally coded and addressed information via said cabling system (C).

2. The electric power distribution system according to claim 1, wherein said distributing means (F) comprises a plurality of distributing means (F), each of said distributing means (F) including at least one respective digital control section, and wherein respective conductors of said cabling system (C), even through ramification, are common to all of said distributing means (F) or groups thereof.

3. The electric power distribution system according to claim 2, wherein each of said distributing means (F) includes measuring means for measuring at least one of voltage and current applied to respective contact means (E).

4. The electric power distribution system according to claim 2, wherein each of said distributing means (F) includes controlling means (14) for adjusting at least one of voltage and current applied to respective contact means (E).

5. The electric power distribution system according to claim 2, wherein each of said distributing means (F) includes both supervisory means for measuring at least one of voltage and current and controlling means for adjusting at least one of said voltage and said current applied to respective contact means (E).

6. The electric power distribution system according to claim 2, wherein said computational means (B) acts as a master device and has controlling status, and wherein said each of said distributing means (F) acts as slave device, so that the computational means (B) at any time can control the communication between said computational means (B) and a selected one of said distributing means (F).

7. The electric power distribution system according to claim 2, wherein each of said distributing means (F) has at least one unique digital address.

8. The electric power distribution system according to claim 2, wherein said contact means (E) comprises wire netting.

9. The electric power distribution system according to claim 2, wherein said contact means (E) comprises at least one drilled-in anode.

10. The electric power distribution system according to claim 1, wherein said cabling system (C) comprises at least three wires for distributing said electric power and said digitally coded and addressed information over separate paths having a maximum of one of said three wires in common.

11. The electric power distribution system according to claim 1, wherein said cabling system (C) comprises a plurality of wires for distributing said electric power and an optical fiber system permitting transmission of said digitally coded and addressed information.

12. The electric power distribution system according to claim 1, wherein said digitally coded and addressed information is generated using a frequency modulation (FM) principle.

13. The electric power distribution system according to claim 1, wherein said digitally coded and addressed information is generated using a frequency shift key (FSK) modulation principle.

14. The electric power distribution system according to claim 1, wherein said distributing means (F) further comprises disconnecting means for disconnecting a respective anode from said electrical power, thereby enabling measurement of decay of potential in said concrete mass near the disconnected respective anode.

15. The electric power distribution system according to claim 1, wherein said cabling system (C) comprises two wires permitting power distribution and transmission of said digitally coded and addressed information on said two wires.

16. The electric power distribution system according to claim 15, wherein said cabling system (C) comprises a plurality of branches.

17. The electric power distribution system according to claim 15, further comprising inductive coupling means for superimposing the digitally coded and addressed information onto said two wires.

18. The electric power distribution system according to claim 1, further comprising capacitive coupling means operatively connected to said cabling system (C) for superimposing said digitally coded and addressed information thereon.

19. The electric power distribution system according to claim 1, wherein said contact means (E) comprises wire netting.

20. The electric power distribution system according to claim 1, wherein said contact means (E) comprises at least one drilled-in anode.

* * * * *